US008238793B2

(12) United States Patent
Nakura et al.

(10) Patent No.: US 8,238,793 B2
(45) Date of Patent: Aug. 7, 2012

(54) BELT DEVICE AND IMAGE FORMING APPARATUS HAVING A BELT CORRECTING UNIT AND AN ADJUSTING UNIT

(75) Inventors: Makoto Nakura, Ibaraki (JP); Junji Shirakawa, Ibaraki (JP); Hiroshi Suzuki, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 429 days.

(21) Appl. No.: 12/332,736

(22) Filed: Dec. 11, 2008

(65) Prior Publication Data

US 2009/0180805 A1 Jul. 16, 2009

(30) Foreign Application Priority Data

Dec. 17, 2007 (JP) ..... 2007-324929

(51) Int. Cl.
*G03G 15/00* (2006.01)

(52) U.S. Cl. ..... 399/165; 399/361

(58) Field of Classification Search ..... 399/16, 399/165, 302, 329, 361; 198/806
See application file for complete search history.

(56) References Cited

U.S. PATENT DOCUMENTS

| | | | | |
|---|---|---|---|---|
| 4,087,169 | A * | 5/1978 | Fantuzzo | 399/313 |
| 4,170,175 | A * | 10/1979 | Conlon, Jr. | 346/74.2 |
| 4,337,598 | A * | 7/1982 | Barth et al. | 451/1 |
| 5,471,289 | A * | 11/1995 | Satoh et al. | 399/328 |
| 5,609,241 | A * | 3/1997 | Shaw | 198/806 |
| 5,991,575 | A * | 11/1999 | Okiyama et al. | 399/165 |
| 6,104,899 | A | 8/2000 | Hokari et al. | |
| 6,431,348 | B2 * | 8/2002 | Malmberg | 198/806 |
| 6,445,895 | B2 * | 9/2002 | Shirasawa et al. | 399/116 |
| 6,457,709 | B1 * | 10/2002 | Madsen et al. | 271/275 |
| 7,424,251 | B2 * | 9/2008 | Watanabe et al. | 399/165 |
| 7,565,095 | B2 * | 7/2009 | Mori | 399/165 |
| 2002/0034400 | A1 * | 3/2002 | Asuwa et al. | 399/165 |
| 2007/0144871 | A1 * | 6/2007 | Tao et al. | 198/810.03 |
| 2008/0240802 | A1 | 10/2008 | Nakura | |
| 2008/0267673 | A1 | 10/2008 | Tao et al. | |
| 2009/0060609 | A1 * | 3/2009 | Watanabe | 399/395 |

FOREIGN PATENT DOCUMENTS

| | | | |
|---|---|---|---|
| EP | 0 608 124 | A2 | 7/1994 |
| EP | 1122200 | A2 * | 8/2001 |
| JP | 1-134881 | | 5/1989 |

(Continued)

OTHER PUBLICATIONS

U.S. Appl. No. 12/199,234, filed Aug. 27, 2008, Satoru Tao, et al.

(Continued)

*Primary Examiner* — David Gray
*Assistant Examiner* — G. M. Hyder
(74) *Attorney, Agent, or Firm* — Oblon, Spivak, McClelland, Maier & Neustadt, L.L.P.

(57) ABSTRACT

A belt member is supported by a plurality of rollers and moves in a predetermined moving direction. A detecting unit detects a displacement of the belt member in its width direction. A correcting unit moves a second end of a first roller from among the rollers in either one of a forward direction and a backward direction while fixing its first end based on a result of detecting the displacement of the belt member such that a tilt of a rotating shaft of the first roller is changed to correct a meandering of the belt member. An adjusting unit adjusts a fixing position of the first end.

16 Claims, 5 Drawing Sheets

FOREIGN PATENT DOCUMENTS

| | | |
|---|---|---|
| JP | 10-142966 | 5/1998 |
| JP | 10-152242 | 6/1998 |
| JP | 2000-75680 | 3/2000 |
| JP | 3082452 | 6/2000 |
| JP | 2000-272772 | 10/2000 |
| JP | 2001-83840 | 3/2001 |
| JP | 2002-040865 | 2/2002 |
| JP | 2003-173090 | 6/2003 |
| JP | 2004-078082 | 3/2004 |
| JP | 2006-343629 | 12/2006 |

OTHER PUBLICATIONS

U.S. Appl. No. 12/198,530, filed Aug. 26, 2008, Makoto Nakura.
U.S. Appl. No. 12/202,663, filed Sep. 2, 2008, Susumu Mikajiri, et al.
Jun. 5, 2012 Japanese Office Action.

* cited by examiner

BELT DEVICE AND IMAGE FORMING APPARATUS HAVING A BELT CORRECTING UNIT AND AN ADJUSTING UNIT

CROSS-REFERENCE TO RELATED APPLICATIONS

The present application claims priority to and incorporates by reference the entire contents of Japanese priority document 2007-324929 filed in Japan on Dec. 17, 2007.

BACKGROUND OF THE INVENTION

1. Field of the Invention

The present invention relates to a belt device capable of correcting a meandering of a belt, such as an intermediate transfer belt, a conveying belt, or a photosensitive element belt, and an image forming apparatus including the belt device.

2. Description of the Related Art

Among image forming apparatuses, such as a copier, a printer, a facsimile machine, and a multifunction product (MFP), a tandem-type color image forming apparatus including an intermediate transfer belt (for example, as disclosed in Japanese Patent Application Laid-open No. 2006-343629 and Japanese Patent Application Laid-open No. 2001-83840) has been commonly used.

In such a tandem-type color image forming apparatus, four photosensitive drums as image carriers are tandemly arranged to be opposed to an intermediate transfer belt. The image forming apparatus forms a full-color image in such a manner that black (K), yellow (Y), magenta (M), and cyan (C) toner images are formed on the photosensitive drums, respectively. The K, Y, M, and C toner images formed on the photosensitive drums are sequentially transferred onto the intermediate transfer belt in a superimposed manner. The superimposed toner image transferred onto the intermediate transfer belt is further transferred onto a recording medium, and thereby forming a full-color image.

Various technologies have developed to improve such an image forming apparatus. For example, an image forming apparatus as disclosed in Japanese Patent Application Laid-open No. 2006-343629 and Japanese Patent Application Laid-open No. 2001-83840 is configured to detect a displacement of an intermediate transfer belt in a width direction. Therefore, the image forming apparatus can correct a meandering of the intermediate transfer belt (the displacement in the width direction) based on a result of the detection.

Specifically, in the image forming apparatus disclosed in Japanese Patent Application Laid-open No. 2006-343629, a displacement sensor detects an amount of displacement of a contact that is in contact with an edge portion of the intermediate transfer belt (an endless belt). When the intermediate transfer belt meanders, the contact oscillates along with the meandering of the intermediate transfer belt, so that the meandering of the intermediate transfer belt can be detected based on a result of the detection by the displacement sensor. The meandering of the intermediate transfer belt is corrected by a meandering correction roller, which is one of rollers supporting the intermediate transfer belt, based on the amount of the displacement of the contact. More specifically, an oscillating arm connected to the meandering correction roller is moved by a movement of an eccentric cam to change the tilt of a rotating shaft of the meandering correction roller, and thereby correcting the meandering of the intermediate transfer belt.

Furthermore, in a belt device disclosed in Japanese Patent No. 3082452, a meandering of a conveying belt (a transfer-medium conveying belt) is corrected in such a manner that a supporting arm connected to a tension applying roller, which is one of rollers supporting the conveying belt, is moved by a movement of a cam to change the tilt of a rotating shaft of the tension applying roller.

Moreover, in a belt device disclosed in Japanese Patent Application Laid-open No. H10-152242, an alignment of a steering roller for correcting a meandering of an endless belt can be manually adjusted.

However, the above conventional technologies have problems. For example, in the image forming apparatus disclosed in Japanese Patent Application Laid-open No. 2006-343629, there are such problems that the apparatus is caused to stop operation because it is determined that a control error occurs when a meandering of the intermediate transfer belt is not corrected within a predetermined time; and a meandering of the intermediate transfer belt cannot be sufficiently corrected within a travel range of the meandering correction roller, i.e., the meandering correction roller cannot be moved enough to correct the meandering of the intermediate transfer belt because of the limitation of the travel range. Such problems are caused, for example, because a plurality of roller members supporting the intermediate transfer belt is installed in the belt device in a state where the parallelism of the roller members is not sufficiently maintained, a frame that rotatably supports the roller members is distorted, or the straightness of the roller members is not sufficiently maintained, so that a default position of the meandering correction roller is significantly deviated in either a forward direction or a backward direction away from a center position of the travel range.

To solve the problems, an assembly accuracy of components of the belt device, such as the roller members and the frame, and an accuracy of each of the components need to be improved. However, in this case, there is a production limitation costwise.

These problems are especially prominent in a case where the apparatus is large in size because a length of the roller members in a direction of the rotating shaft gets longer.

Incidentally, the above problems are not limited to a belt device employing an intermediate transfer belt as a belt member, but are common issues among belt devices that correct a meandering of a belt member regardless of a type of the belt member.

SUMMARY OF THE INVENTION

It is an object of the present invention to at least partially solve the problems in the conventional technology.

According to one aspect of the present invention, there is provided a belt device including a belt member that is supported by a plurality of rollers and moves in a predetermined moving direction; a detecting unit that detects a displacement of the belt member in its width direction; a correcting unit that moves a second end of a first roller from among the rollers in either one of a forward direction and a backward direction while fixing its first end based on a result of detecting the displacement of the belt member such that a tilt of a rotating shaft of the first roller is changed to correct a meandering of the belt member; and an adjusting unit that adjusts a fixing position of the first end.

Furthermore, according to another aspect of the present invention, there is provided an image forming apparatus including a belt device. The belt device includes a belt member that is supported by a plurality of rollers and moves in a predetermined moving direction, a detecting unit that detects a displacement of the belt member in its width direction, a correcting unit that moves a second end of a first roller from among the rollers in either one of a forward direction and a backward direction while fixing its first end based on a result of detecting the displacement of the belt member such that a tilt of a rotating shaft of the first roller is changed to correct a meandering of the belt member, and an adjusting unit that adjusts a fixing position of the first end.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is a perspective view of a portion of the belt device around a correction roller viewed from a back side of which;

FIG. 8 is a perspective view of a portion of the belt device around the correction roller viewed from a front side of which;

DETAILED DESCRIPTION OF THE PREFERRED EMBODIMENTS

Exemplary embodiments of the present invention are explained in detail below with reference to the accompanying drawings.

First, a configuration and an operational behavior of an image forming apparatus including a belt device according to an embodiment of the present invention are explained below with reference to FIGS. 1 and 2.

Figure 1:
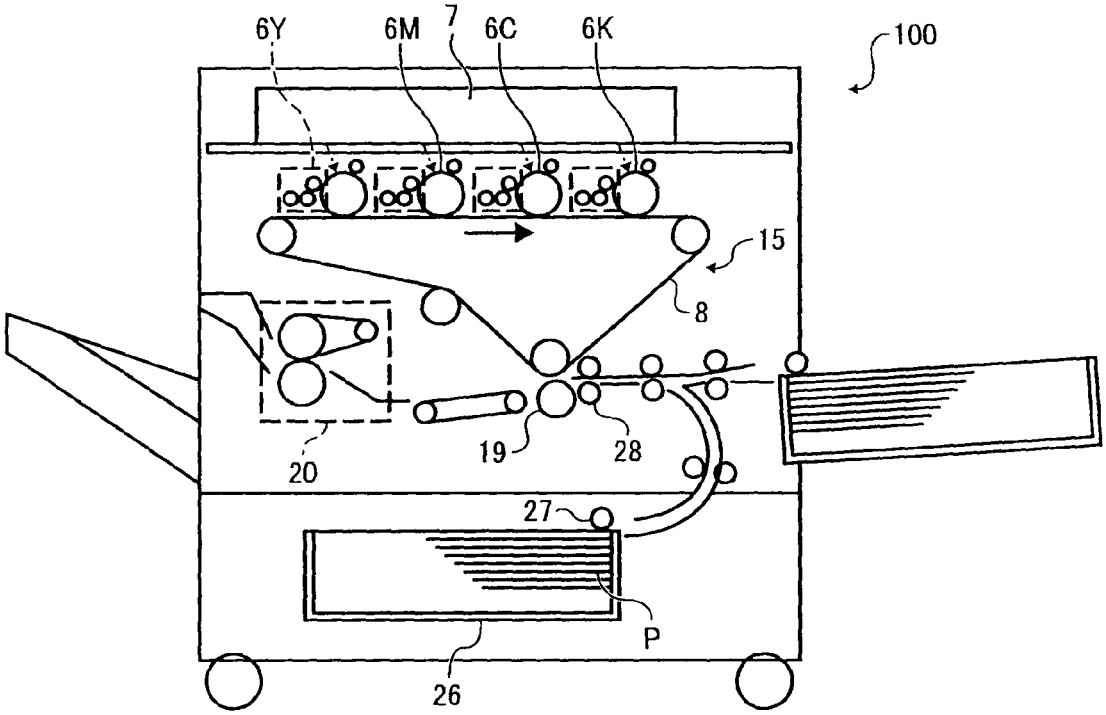
FIG. 1 is a side view of an image forming apparatus including a belt device according to an embodiment of the present invention.

FIG. 1 is a side view of a printer 100 as the image forming apparatus according to the embodiment of the present invention.

As shown in FIG. 1, the printer 100 includes a belt device 15, process units 6Y, 6M, 6C, and 6K, an exposure unit 7, a secondary transfer roller 19, a sheet feed unit 26, a sheet feed roller 27, a pair of registration rollers 28, and a fixing unit 20. The belt device 15 is arranged in the center of a main body of the printer 100. The belt device 15 includes an intermediate transfer belt 8. The process units 6Y, 6M, 6C, and 6K are tandemly arranged to be opposed to the intermediate transfer belt 8, and respectively form yellow (Y), magenta (M), cyan (C), and black (K) toner images. The exposure unit 7 is arranged above the process units 6Y, 6M, 6C, and 6K.

The process units 6Y, 6M, 6C, and 6K have the same configuration except for a color of toner used in each of the process units. Therefore, the process unit 6Y is explained as an example of all the process units, and the description of the process units 6M, 6C, and 6K is omitted.

Figure 2:
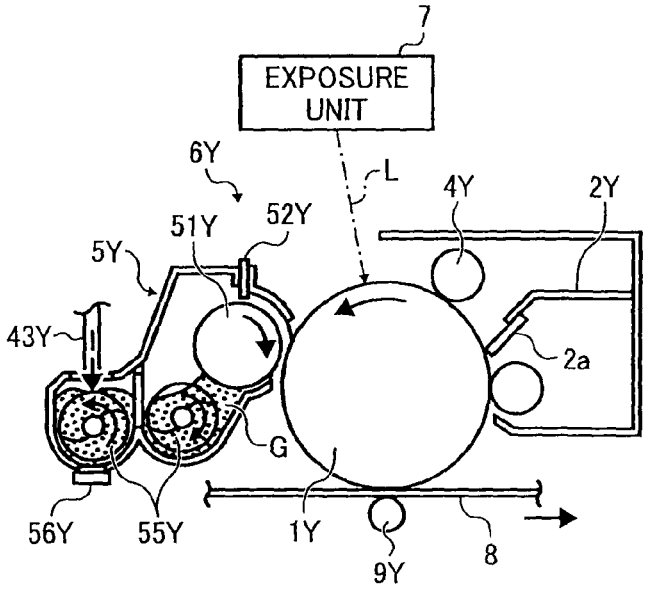
FIG. 2 is an enlarged view of a process unit of the image forming apparatus.

FIG. 2 is an enlarged view of the process unit 6Y. As shown in FIG. 2, the process unit 6Y includes a photosensitive drum 1Y as an image carrier, a charging unit 4Y, a developing unit 5Y, a cleaning unit 2Y, and a neutralizing unit (not shown). The charging unit 4Y, the developing unit 5Y, the cleaning unit 2Y, and the neutralizing unit are arranged around the photosensitive drum 1Y. Incidentally, each of the process units 6M, 6C, and 6K has the same configuration as the process unit 6Y, and elements included in each of the process units 6M, 6C, and 6K are denoted with the same reference numerals as those included in the process unit 6Y with suffix of "M", "C", and "K".

A process of forming a Y-toner image on the photosensitive drum 1Y performed by the process unit 6Y is explained below with reference to FIG. 2.

The photosensitive drum 1Y is driven to rotate in a counterclockwise direction by a drive motor (not shown). At a position opposed to the charging unit 4Y, a surface of the photosensitive drum 1Y is uniformly charged by the charging unit 4Y.

After that, when the charged portion of the surface of the photosensitive drum 1Y comes to an exposure position due to the rotation of the photosensitive drum 1Y, the surface of the photosensitive drum 1Y is exposed to a laser light L emitted from the exposure unit 7, whereby an electrostatic latent image corresponding to Y image data is formed on the surface of the photosensitive drum 1Y.

When the portion of the surface of the photosensitive drum 1Y where the electrostatic latent image is formed comes to a position opposed to the developing unit 5Y, the electrostatic latent image is developed into a Y-toner image by the developing unit 5Y.

When the portion of the surface of the photosensitive drum 1Y where the Y-toner image is formed comes to a position opposed to a transfer roller 9Y across the intermediate transfer belt 8, the Y-toner image formed on the photosensitive drum 1Y is primary-transferred onto the intermediate transfer belt 8. At this time, a residual toner remains on the surface of the photosensitive drum 1Y.

When the portion of the surface of the photosensitive drum 1Y where the residual toner remains comes to a position opposed to the cleaning unit 2Y, the residual toner is removed from the surface of the photosensitive drum 1Y by a cleaning blade 2*a*, and collected in the cleaning unit 2Y.

After that, when the portion of the surface of the photosensitive drum 1Y comes to a position opposed to the neutralizing unit, a residual potential remaining on the surface of the photosensitive drum 1Y is removed by the neutralizing unit.

In this manner, the process of forming the Y-toner image on the photosensitive drum 1Y is complete.

The above process is performed by each of the process units 6M, 6C, and 6K in the same manner as the process unit 6Y. Specifically, a light source of the exposure unit 7 emits laser lights L corresponding to M, C, and K image data toward photosensitive drums 1M, 1C, and 1K respectively. Each of the laser lights L emitted from the light source is deflected by a polygon mirror driven to rotate, and emitted to the corresponding photosensitive drum via a plurality of optical elements.

After electrostatic latent images formed on the photosensitive drums 1Y, 1M, 1C, and 1K are developed into Y, M, C, and K toner images, the Y, M, C, and K toner images are sequentially transferred onto the intermediate transfer belt 8 in a superimposed manner, and thereby forming a full-color toner image on the intermediate transfer belt 8.

Figure 3:
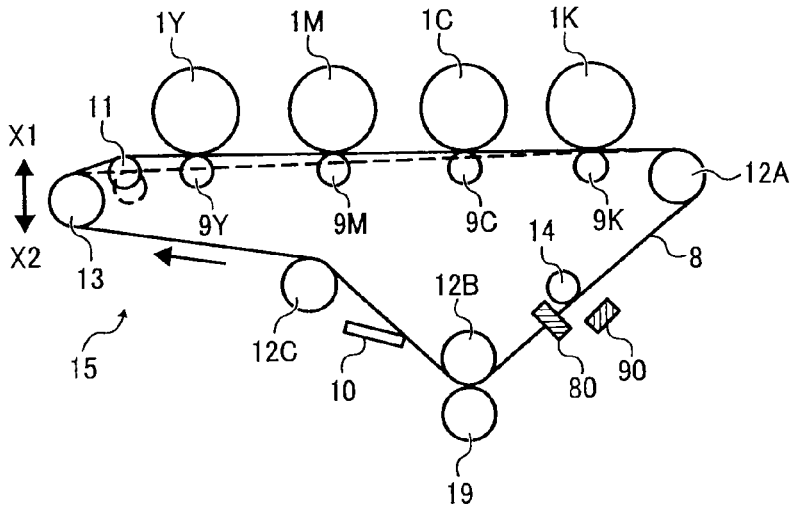
FIG. 3 is a configuration diagram of the belt device.

Subsequently, a process of transferring the full-color toner image onto the intermediate transfer belt 8 is explained below with reference to FIG. 3. As shown in FIG. 3, the belt device 15 includes the intermediate transfer belt 8, the four transfer rollers 9Y, 9M, 9C, and 9K, a drive roller 12A, a secondary-transfer roller 12B, a tension roller 12C, a correction roller 13, a movable roller 11, a regulating roller 14, a detecting unit 80, a photosensor 90, and a belt cleaning unit 10. The intermediate transfer belt 8 is supported by the movable roller 11, the drive roller 12A, the secondary-transfer roller 12B, the tension roller 12C, and the correction roller 13 (hereinafter, "the supporting rollers 11, 12A to 12C, and 13"). The intermediate transfer belt 8 moves endlessly in a direction of an arrow shown in FIG. 3 in accordance with the rotation of the drive roller 12A.

The transfer rollers 9Y, 9M, 9C, and 9K are arranged to be opposed to the photosensitive drums 1Y, 1M, 1C, and 1K across the intermediate transfer belt 8. Primary-transfer nip portions are formed between the photosensitive drums 1Y, 1M, 1C, and 1K and the transfer rollers 9Y, 9M, 9C, and 9K, respectively. A transfer voltage (a transfer bias) of an opposite polarity to that of the toners is applied to the transfer rollers 9Y, 9M, 9C, and 9K.

The intermediate transfer belt 8 moves in the direction of the arrow, and sequentially passes through the primary-transfer nip portions. As a result, the Y, M, C, and K toner images formed on the photosensitive drums 1Y, 1M, 1C, and 1K are primary-transferred onto the intermediate transfer belt 8 in a superimposed manner.

The secondary-transfer roller 12B is arranged to be opposed to the secondary transfer roller 19 across the intermediate transfer belt 8. A secondary-transfer nip portion is formed between the secondary-transfer roller 12B and the secondary transfer roller 19. When the intermediate transfer belt 8 onto which the superimposed full-color toner image is primary-transferred passes through the secondary-transfer nip portion, the full-color toner image is secondary-transferred onto a recording medium P conveyed to the secondary-transfer nip portion. At this time, a residual toner remains on the intermediate transfer belt 8.

When the intermediate transfer belt 8 comes to a position opposed to the belt cleaning unit 10, the residual toner is removed from the intermediate transfer belt 8 by the belt cleaning unit 10.

In this manner, the process of transferring the full-color toner image onto the intermediate transfer belt 8 is complete. Incidentally, a configuration and an operational behavior of the belt device 15 will be explained in detail later with reference to FIGS. 3 to 9.

How the recording medium P is conveyed to the secondary-transfer nip portion is explained with reference to FIG. 1. A recording medium P is fed from the sheet feed unit 26 arranged on the lower part of the main body of the printer 100 (or a sheet feed unit arranged on the side part of the main body), and conveyed to the secondary-transfer nip portion via the sheet feed roller 27 and the registration rollers 28.

Specifically, a stack of recording media P, such as transfer sheets, is contained in the sheet feed unit 26. When the sheet feed roller 27 is driven to rotate in the counterclockwise direction in FIG. 1, a top recording medium P of the stack is picked up and fed toward the registration rollers 28.

The recording medium P conveyed to the registration rollers 28 is temporarily stopped at a nip portion formed between the registration rollers 28 that are not driven to rotate, i.e., stop rotating at this time. In synchronization with a timing of the full-color toner image on the intermediate transfer belt 8, the registration rollers 28 are driven to rotate, and the recording medium P is conveyed to the secondary-transfer nip portion through the registration rollers 28. By passing through the secondary-transfer nip portion, the full-color toner image is transferred onto the recording medium P.

After that, the recording medium P on which the full-color toner image is transferred is conveyed to the fixing unit 20. In the fixing unit 20, the full-color toner image is fixed on the recording medium P by the application of heat and pressure by a fixing roller and a pressure roller, and thereby forming a full-color image on the recording medium P.

Then, the recording medium P is discharged from the printer 100 by a pair of discharge rollers (not shown), and stacked on a stack unit.

In this manner, a series of processes for forming the full-color image performed by the printer 100 is complete.

Subsequently, a configuration and an operational behavior of the developing unit 5 are explained in detail below by taking the developing unit 5Y of the process unit 6Y as an example.

As shown in FIG. 2, the developing unit 5Y includes a developing roller 51Y, a doctor blade 52Y, two conveying screws 55Y, a toner replenishing path 43Y, and a toner-concentration detecting sensor 56Y. The developing roller 51Y is arranged to be opposed to the photosensitive drum 1Y. The developing roller 51Y is composed of a magnet and a sleeve. The magnet is fixedly-mounted inside the developing roller 51Y, and covered with the sleeve. The sleeve is capable of rotating around the magnet. The doctor blade 52Y is arranged to be opposed to the developing roller 51Y. The conveying screws 55Y are provided in a developer containing unit. The developer containing unit is separated into two separate areas, and the conveying screws 55Y are respectively arranged in the separate areas. The developer containing unit contains a two-component developer composed of a carrier and a toner. The toner replenishing path 43Y is communicated with the developer containing unit via an opening formed on the developer containing unit. The toner-concentration detecting sensor 56Y detects a concentration of the toner contained in the developer.

The sleeve of the developing roller 51Y rotates in a direction of an arrow shown in FIG. 2. The developer is carried on the developing roller 51Y by the action of a magnetic field generated by the magnet. The developer moves over the surface of the developing roller 51Y in accordance with the rotation of the sleeve. The developer is adjusted so that a ratio (a concentration) of the toner in the developer falls within a predetermined range.

When a toner is replenished into the developer containing unit (see a dashed arrow shown in FIG. 2), the toner is circulated through the two separate areas of the developer containing unit while being agitated by the conveying screws 55Y so as to be mixed with the developer. The toner in the developer is adhered to the carrier due to an electrostatic charge caused by a friction with the carrier, and carried on the developing roller 51Y together with the carrier by the action of a magnetic force generated on the developing roller 51Y.

The developer carried on the developing roller 51Y is conveyed in the direction of the arrow shown in FIG. 2. At a position opposed to the doctor blade 52Y, an excessive amount of the developer on the developing roller 51Y is scraped off to an appropriate amount by the doctor blade 52Y so as to uniform the developer on the developing roller 51Y, and conveyed to a position opposed to the photosensitive drum 1Y (a developing area). The toner is adhered to the latent image formed on the photosensitive drum 1Y by an electrostatic charge generated in the developing area. When the developer remaining on the developing roller 51Y comes to the upper side of the developer containing unit in accordance with the rotation of the sleeve, the developer is come off from the developing roller 51Y.

Subsequently, the configuration and the operational behavior of the belt device 15 according to the present embodiment are explained in detail below with reference to FIGS. 3 to 9.

Figure 4A:
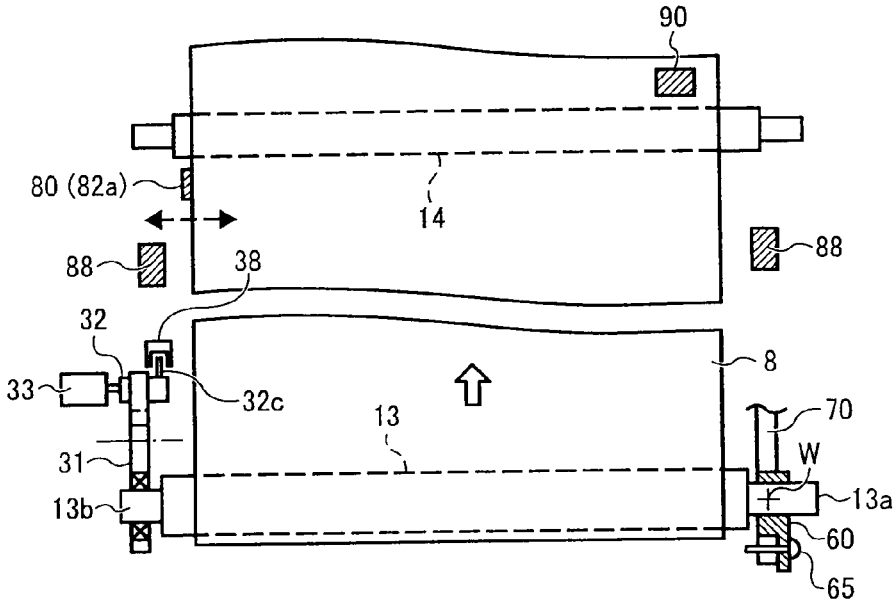
FIGS. 4A and 4B are respectively a top view and a side view of a portion of the belt device viewed in a width direction of an intermediate transfer belt.
Figure 4B:
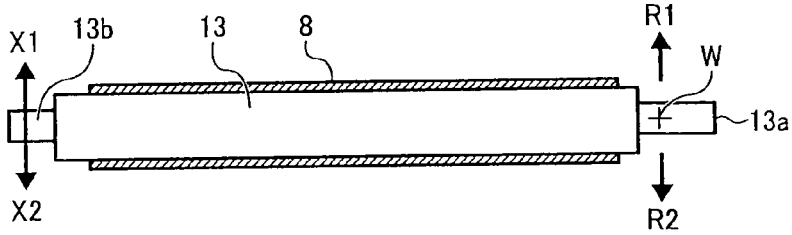
Figure 5:
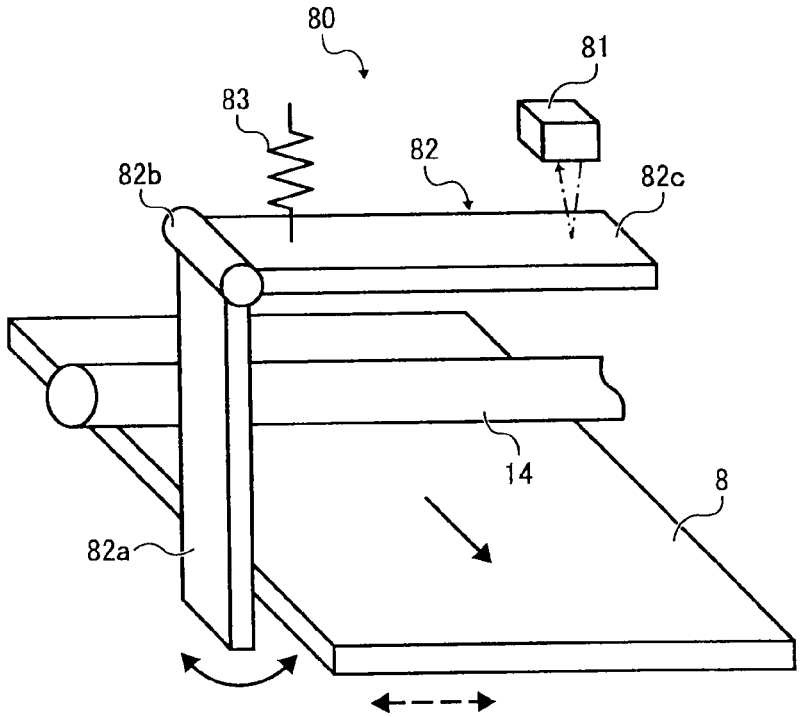
FIG. 5 is a perspective view of a portion of the belt device around a detecting unit.
Figure 6:
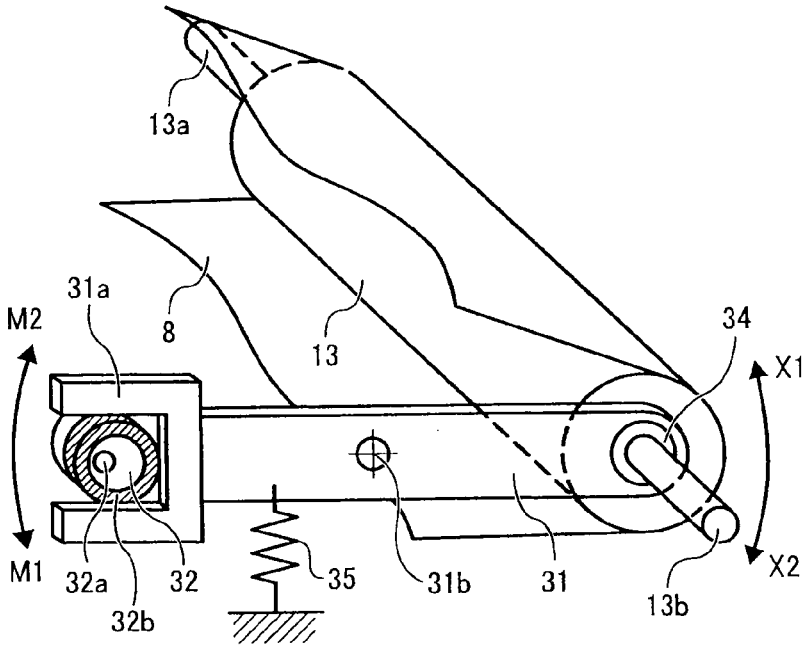
Figure 7A:
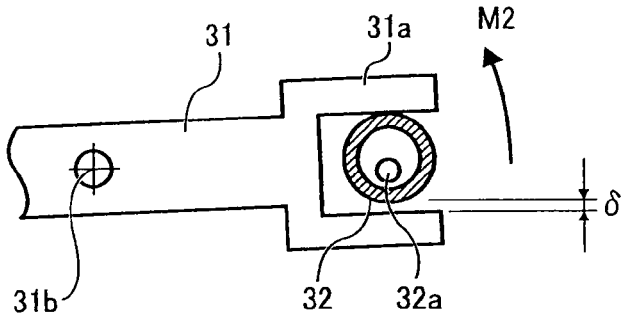
FIGS. 7A and 7B are schematic diagrams for explaining a movement of a connecting member.
Figure 7B:
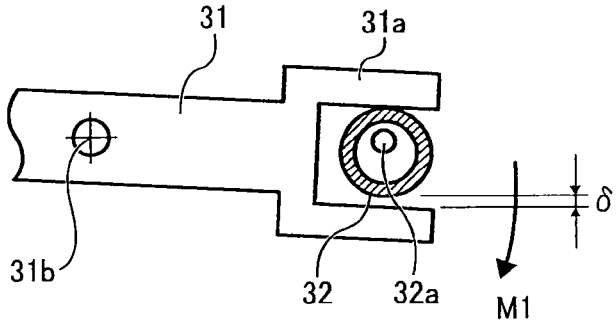
Figure 8:
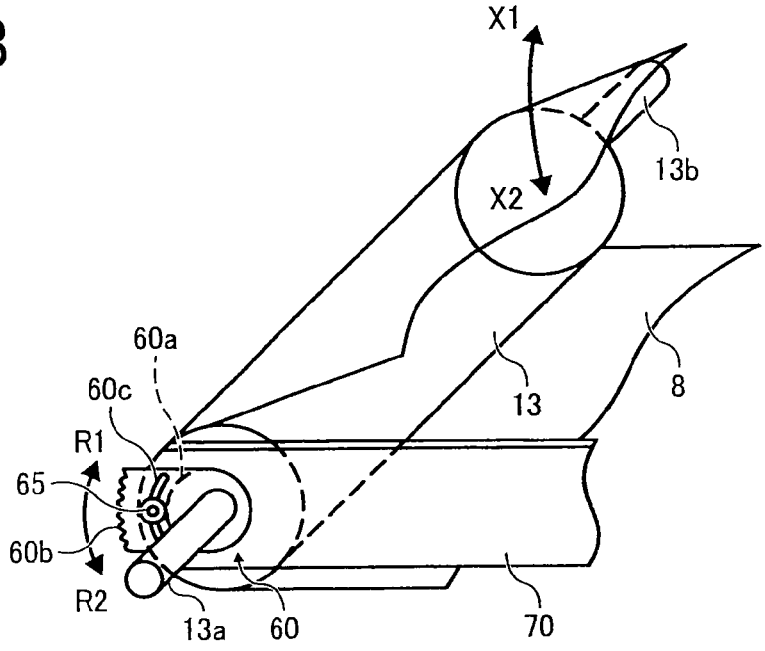
Figure 9A:
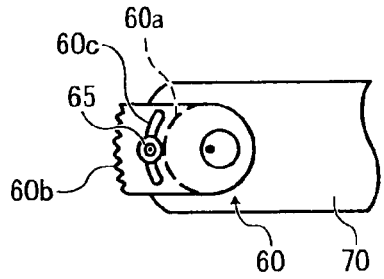
FIGS. 9A to 9C are schematic diagrams for explaining a movement of an adjusting member shown in FIG. 8.
Figure 9B:
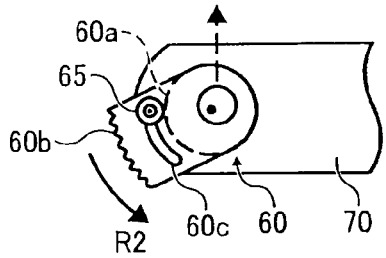
Figure 9C:
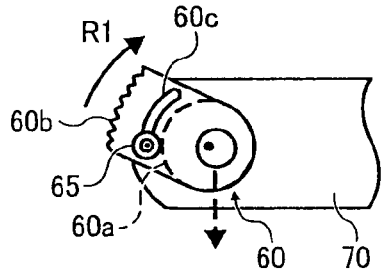

FIG. 3 is a configuration diagram of the belt device 15. FIG. 4A is a top view of a portion of the belt device 15 viewed in a width direction of the intermediate transfer belt 8. FIG. 4B is a side view of the portion of the belt device 15 shown in FIG. 4A. FIG. 5 is a perspective view of a portion of the belt device 15 around the detecting unit 80. FIG. 6 is a perspective view of a portion of the belt device 15 around the correction roller 13 viewed from the back side of which. FIGS. 7A and 7B are schematic diagrams for explaining a movement of an oscillating arm 31 as a connecting member. FIG. 8 is a perspective view of a portion of the belt device 15 around the correction roller 13 viewed from the front side of which. FIGS. 9A to 9C are schematic diagrams for explaining a movement of an adjusting member 60.

As shown in FIGS. 3, 4A, and 4B, the belt device 15 includes the intermediate transfer belt 8, the transfer rollers 9Y, 9M, 9C, and 9K, the drive roller 12A, the secondary-transfer roller 12B, the tension roller 12C, the correction roller 13, the movable roller 11, the regulating roller 14, the detecting unit 80, the photosensor 90, the belt cleaning unit 10, and error detecting sensors 88.

The intermediate transfer belt 8 is arranged to be opposed to the photosensitive drums 1Y, 1M, 1C, and 1K. The intermediate transfer belt 8 is mainly supported by the five supporting rollers, i.e., the drive roller 12A, the secondary-transfer roller 12B, the tension roller 12C, the movable roller 11, and the correction roller 13.

In the present embodiment, as the intermediate transfer belt 8, the one made of a single-layered or multilayered resin, such as polyvinylidine difluoride (PVDF), ethylen etetrafluoroeyhylene copolymer (ETFE), poryimide (PI), and polycarbonate (PC), in which a conductive material such as carbon black is dispersed is employed. The intermediate transfer belt 8 is adjusted to have a volume resistivity in a range of $10^7$ Ω·cm to $10^{12}$ Ω·cm and a surface resistivity of a rear surface of which in a range of $10^8$ Ω/sq to $10^{12}$ Ω/sq. Furthermore, a thickness of the intermediate transfer belt 8 is preferably within a range of 80 micrometers (μm) to 100 μm. In the present embodiment, the one having a thickness of 90 μm is employed as the intermediate transfer belt 8.

If needed, the surface of the intermediate transfer belt 8 can be coated with a release layer made of fluorine contained resin such as, but not limited to, ETFE, polytetrafluoroethylene (PTFE), PVDF, perfluoro alkoxyl alkane (PFA), fluorinated ethylene propylene copolymer (FEP), and polyvinyl fluoride (PVF).

As a method for manufacturing the intermediate transfer belt 8, there are a cast molding method, a centrifugal molding method, and the like. The surface of the intermediate transfer belt 8 is polished if needed.

The transfer rollers 9Y, 9M, 9C, and 9K are respectively opposed to the photosensitive drums 1Y, 1M, 1C, and 1K across the intermediate transfer belt 8.

The movable roller 11 is supported by a supporting member (not shown) together with the transfer rollers 9Y, 9M, 9C, and 9K. The movable roller 11 is configured to cause the intermediate transfer belt 8 to come in contact with or move away from the photosensitive drums 1Y, 1M, 1C, and 1K.

Specifically, when the movable roller 11 moves downward together with the transfer rollers 9Y, 9M, 9C, and 9K, the intermediate transfer belt 8 is moved away from the photosensitive drums 1Y, 1M, 1C, and 1K as indicated by a dashed line in FIG. 3. The reason why the intermediate transfer belt 8 is moved away from the photosensitive drums 1Y, 1M, 1C, and 1K is to reduce wear and deterioration of the intermediate transfer belt 8. The intermediate transfer belt 8 is moved away from the photosensitive drums 1Y, 1M, 1C, and 1K while no image is formed. When a monochrome image is to be formed, although it is not illustrated in the drawing, the movable roller 11 moves downward together with the three transfer rollers 9Y, 9M, and 9C so that the intermediate transfer belt 8 is in contact with only the photosensitive drum 1K.

The drive roller 12A is driven to rotate by a drive motor (not shown). The intermediate transfer belt 8 moves in a predetermined moving direction (in a clockwise direction in FIG. 3) in accordance with the rotation of the drive roller 12A.

The secondary-transfer roller 12B is in contact with the secondary transfer roller 19 across the intermediate transfer belt 8. The tension roller 12C is in contact with an outer circumferential surface of the intermediate transfer belt 8. The belt cleaning unit 10 (a cleaning blade) is arranged between the secondary-transfer roller 12B and the tension roller 12C.

The detecting unit 80 detects a displacement of the intermediate transfer belt 8 in the width direction (in a vertical direction with respect to a sheet face of FIG. 3).

Specifically, as shown in FIG. 5, the detecting unit 80 includes an oscillating member 82, a displacement detecting sensor 81, and a spring 83. The oscillating member 82 is set to be in contact with an edge portion of the intermediate transfer belt 8 in the width direction. The displacement detecting sensor 81 detects an amount of displacement of the oscillating member 82. The spring 83 is attached to the oscillating member 82 to bias the oscillating member 82 in such a direction that the oscillating member 82 comes in contact with the intermediate transfer belt 8.

The oscillating member 82 is composed of a first arm portion 82*a*, an oscillating spindle 82*b*, and a second arm portion 82*c*. One end of the first arm portion 82*a* is in contact with the edge portion of the intermediate transfer belt 8 in the width direction, and the other end is fixed to the oscillating spindle 82*b*. The oscillating spindle 82*b* is rotatably supported by an enclosure (not shown) of the belt device 15. One end of the second arm portion 82*c* is fixed to the oscillating spindle 82*b*. One end of the spring 83 is attached to the center of the second arm portion 82*c*, and the other end is attached to the enclosure.

The oscillating member 82 oscillates (in a direction of a solid two-headed arrow shown in FIG. 5) along with a displacement of the intermediate transfer belt 8 in the width direction (in a direction of a dashed two-headed arrow shown in FIG. 5). Incidentally, in the present embodiment, the intermediate transfer belt 8 is set to move in the moving direction (in a direction of an arrow shown in FIG. 5) at a speed of 400 millimeters per second.

The displacement detecting sensor 81 is fixed to the enclosure to be arranged above the other end of the second arm portion 82*c*. The displacement detecting sensor 81 includes a light-emitting element (an infrared light-emitting diode) and a position detecting element (a position sensitive detector (PSD)). The light-emitting element and the position detecting element are arranged in parallel in a horizontal direction with keeping a distance between them. An infrared light emitted from the light-emitting element is reflected on a surface of the second arm portion 82*c*, and the reflected light enters into the position detecting element. An incident position of the reflected light varies depending on a distance between the displacement detecting sensor 81 and the surface of the second arm portion 82*c*, and an output value of a light-receiving element (the displacement detecting sensor 81) also varies in proportion to the incident position. Therefore, an amount of displacement of the intermediate transfer belt 8 in the width direction (i.e., a distance between the displacement detecting sensor 81 and the surface of the second arm portion 82*c*) can be detected. Specifically, when a distance detected by the displacement detecting sensor 81 is smaller than a predetermined value, the intermediate transfer belt 8 is displaced on the right side in FIG. 5 from a target position. On the other hand, when a distance detected by the displacement detecting sensor 81 is larger than the predetermined value, the intermediate transfer belt 8 is displaced on the left side in FIG. 5 from the target position.

The regulating roller 14 is arranged near the detecting unit 80. The regulating roller 14 regulates a displacement of the intermediate transfer belt 8 in a direction other than the width direction and the moving direction. Specifically, the regulating roller 14 is arranged near a contact point where the oscillating member 82 (the first arm portion 82*a*) is in contact with the intermediate transfer belt 8 (on the upstream side of the contact point in the moving direction of the intermediate transfer belt 8).

By such a configuration, it is possible to reduce a displacement (a deflection) of the intermediate transfer belt 8 in a direction perpendicular to the width direction (in a vertical direction with respect to a sheet face of FIG. 4A) at a position of the detecting unit 80 (at the contact point between the oscillating member 82 and the intermediate transfer belt 8). In other words, the regulating roller 14 increases the tension of the intermediate transfer belt 8 thereby regulating the displacement of the intermediate transfer belt 8 in the direction perpendicular to the width direction at the position of the detecting unit 80. Therefore, it is possible to reduce such a disadvantageous possibility that the detecting unit 80 detects not only a displacement to be originally detected (i.e., a displacement in the width direction) but also a displacement in a different direction from the width direction and the moving direction. Thus, it is possible to improve a detection accuracy of the detecting unit 80, i.e., the detecting unit 80 can detect a bias of the intermediate transfer belt 8 at high accuracy.

When the detecting unit 80 detects a displacement (an amount of displacement) of the intermediate transfer belt 8, the correction roller 13 corrects the displacement of the intermediate transfer belt 8 in the width direction based on a result of the detection by the detecting unit 80. If the correction roller 13 fails to correct the meandering of the intermediate transfer belt 8 within a predetermined time (i.e., the result of the detection by the detecting unit 80 is not altered within the predetermined time), it is determined that a control error in meandering correction occurs, whereby the belt device 15 is caused to stop operation.

As shown in FIG. 3, the correction roller 13 is arranged on the upstream side of the photosensitive drums 1Y, 1M, 1C, and 1K in the moving direction of the intermediate transfer belt 8, and is in contact with an inner circumferential surface of the intermediate transfer belt 8. Furthermore, as shown in FIGS. 4B and 6, the correction roller 13 is configured to be capable of oscillating in directions X1 and X2 (in up and down directions) around an oscillating center W, which is fixedly-supported by a frame 70 via the adjusting member 60, in accordance with the oscillation of the oscillating arm 31 due to the rotation of a cam 32.

When the intermediate transfer belt 8 is displaced (biased) on the right side in FIG. 4A, the correction roller 13 oscillates in the direction X1 based on a result of the detection by the detecting unit 80 so as to correct the displacement (the meandering) of the intermediate transfer belt 8. On the other hand, when the intermediate transfer belt 8 is displaced on the left side in FIG. 4A, the correction roller 13 oscillates in the direction X2 based on a result of the detection by the detecting unit 80 so as to correct the displacement (the meandering) of the intermediate transfer belt 8. Therefore, it is possible to prevent the intermediate transfer belt 8 from meandering, and also prevent the intermediate transfer belt 8 from being damaged, for example, by having contact with other components due to a significant displacement (bias) of which in the width direction.

Incidentally, a configuration and an operational behavior of the correcting roller 13 (a meandering correcting mechanism) will be explained in detail later with reference to FIGS. 6, 7A, and 7B.

In the present embodiment, the detecting unit 80 and the regulating roller 14 are arranged to be away from the correction roller 13. Specifically, the correction roller 13 is arranged on the upstream side of the photosensitive drums 1Y, 1M, 1C, and 1K in the moving direction of the intermediate transfer belt 8, while on the other hand, the detecting unit 80 and the regulating roller 14 are arranged on the downstream side of the photosensitive drums 1Y, 1M, 1C, and 1K in the moving direction of the intermediate transfer belt 8.

By arranging the detecting unit 80 and the regulating roller 14 to be away from the correction roller 13, there is no decrease in a regulating force exerted on the intermediate transfer belt 8 by the regulating roller 14 (a force restraining the intermediate transfer belt 8 from being displaced in the perpendicular direction) even when the correction roller 13 oscillates to correct the displacement. Therefore, the detection accuracy of the detecting unit 80 can be improved.

In the belt device 15, as shown in FIG. 4A, the error detecting sensors 88 are provided at both sides of the intermediate transfer belt 8 with keeping a predetermined distance (about 5 millimeters) from the edge portions of the intermediate transfer belt 8 in the width direction, respectively.

Although it is not illustrated in the drawing, each of the error detecting sensors 88 includes an arm member and an optical sensor. The arm member has contact with the intermediate transfer belt 8 if the intermediate transfer belt 8 is significantly biased, and moves around an oscillating spindle along with the displacement of the intermediate transfer belt 8. The optical sensor optically senses the movement of the arm member.

The error detecting sensors 88 detect an error, i.e., whether the intermediate transfer belt 8 is biased beyond a correctable range of displacement that can be corrected by the correction roller 13. When an error is detected by the error detecting sensors 88, the drive roller 12A is forced to stop rotating so as to stop the movement of the intermediate transfer belt 8, and an error message "call a serviceman" (claiming for a service by a serviceman) is displayed on a display unit (not shown) of the printer 100.

Furthermore, in the belt device 15, as shown in FIGS. 3 and 4A, the photosensor 90 is arranged near the regulating roller 14. The photosensor 90 detects a position and a toner concentration of a toner image carried on the intermediate transfer belt 8. Specifically, after Y, M, C, and K toner images are transferred onto the intermediate transfer belt 8 as described above, the photosensor 90 optically detects a misalignment of each of the Y, M, C, and K toner images based on a patch pattern formed on the intermediate transfer belt 8. Based on a result of the misalignment detected by the photosensor 90, an exposure timing of each of laser lights L to be emitted from the exposure unit 7 to the photosensitive drums 1Y, 1M, 1C, and 1K is adjusted. Furthermore, the photosensor 90 optically detects a toner concentration of each of the Y, M, C, and K toner images based on a patch pattern formed on the intermediate transfer belt 8. Based on a result of the toner concentration detected by the photosensor 90, a concentration of each of Y, M, C, and K toners contained in developers in the developing units 5Y, 5M, 5C, and 5K is adjusted.

In this manner, the photosensor 90 is arranged near the regulating roller 14, so that the photosensor 90 can detect a position and a toner concentration of each of the toner images in a state where the deflection of the surface of the intermediate transfer belt 8 is reduced by the regulating roller 14. Therefore, a distance between the photosensor 90 and the toner images can be stabilized, so that it is possible to improve a detection accuracy of the photosensor 90, i.e., the photosensor 90 can detect a position and a toner concentration of each of the toner images at high accuracy.

Subsequently, the configuration and the operational behavior of the correction roller 13 (the meandering correcting mechanism) is explained in detail below.

One end of the correction roller 13 (on the right side in FIGS. 4A and 4B, i.e., the front side (the operating side) of the belt device 15) is fixed, and the other end (on the left side in FIGS. 4A and 4B, i.e., the back side of the belt device 15) is configured to be movable in forward and backward directions (in the up and down directions). The meandering correcting mechanism causes the other end of the correction roller 13 to move in either the forward or backward direction to change the tilt of a rotating shaft of the correction roller 13, and thereby correcting a meandering of the intermediate transfer belt. As shown in FIGS. 4A, 4B, and 6, the meandering correcting mechanism is composed of the correction roller 13 (one of the supporting rollers supporting the intermediate transfer belt 8), the oscillating arm 31, the cam 32, a tension spring 35, a drive motor (a stepping motor) 33, and a position detecting sensor 38.

The oscillating arm 31 is made of a metal plate, and connected to a shaft portion 13*b* of the correction roller 13 (on the opposite side of the fixed end). Specifically, as shown in FIG. 6, one end of the oscillating arm 31 is connected to the shaft portion 13*b* of the correction roller 13 via a bearing 34. A square U-shaped contact portion 31*a* is formed on the other end of the oscillating arm 31. The contact portion 31*a* holds the cam 32 in forward and backward directions M1 and M2. A center portion of the oscillating arm 31 (preferably on the side of the contact portion 31*a*) is rotatably supported by a side plate (not shown) of the belt device 15. The center portion of the oscillating arm 31 is referred to as an oscillating center 31*b*. Namely, the oscillating arm 31 oscillates around the oscillating center 31*b*.

In the present embodiment, one end of the tension spring 35 as a biasing member is attached to the oscillating arm 31 at a position between the contact portion 31*a* and the oscillating center 31*b*. The other end of the tension spring 35 is attached to the enclosure of the belt device 15. By the action of the tension spring 35, the oscillating arm 31 is biased so that the contact portion 31*a* is reliably in contact with the cam 32.

The cam 32 is in contact with the contact portion 31*a*, and causes the oscillating arm 31 to move in either the forward or backward direction (in any of the directions M1 and M2 or any of the directions X1 and X2 shown in FIG. 6) due to the rotation of which to change the tilt of the rotating shaft of the correction roller 13 with respect to the moving direction thereby correcting the meandering of the intermediate transfer belt 8.

Specifically, an outer circumferential surface of the cam 32, which is in contact with the contact portion 31*a*, has a circular shape. By eccentric rotation of the cam 32, the oscillating arm 31 is moved in either the forward direction or the backward direction. More specifically, a shaft 32*a* of the cam 32 is arranged at an eccentric position, and connected to the stepping motor 33. The cam 32 is driven to rotate eccentrically around the shaft 32*a* by the stepping motor 33.

Incidentally, the outer circumferential surface of the cam 32 is covered with a bearing 32*b*. Specifically, the bearing 32*b* is a ball bearing, and balls are put into a space between the bearing 32*b* and a metal body of the cam 32. By the use of the ball bearing as the bearing 32*b*, a friction between the contact portion 31*a* and the cam 32 is reduced, so that it is possible to reduce wear and deterioration of both the oscillating arm 31 (the contact portion 31*a*) and the cam 32.

The operational behavior of the meandering correcting mechanism is explained in detail below with reference to FIGS. 7A and 7B.

As shown in FIG. 7A, when the shaft 32*a* is located lower than the center of the cam 32 due to the rotation of the cam 32, the cam 32 is in contact with a top inner surface of the contact portion 31*a*, so that the contact portion 31*a* is pushed up in the direction M2 (the forward direction). As a result, the correction roller 13 is moved in the direction X2 shown in FIG. 6 around the oscillating center W.

On the other hand, as shown in FIG. 7B, when the shaft 32*a* is located higher than the center of the cam 32 due to the rotation of the cam 32, the contact portion 31*a* is pushed down in the direction M1 (the backward direction) by a bias force of the tension spring 35 in a state where the cam 32 is in contact with the top inner surface of the contact portion 31*a*. As a result, the correction roller 13 is moved in the direction X1 shown in FIG. 6 around the oscillating center W.

As shown in FIGS. 7A and 7B, a tiny gap δ is provided between the contact portion 31*a* and the cam 32. Therefore, the cam 32 can be prevented from being nipped into the contact portion 31*a*.

Furthermore, as shown in FIG. 4A, a detection plate 32*c* is installed on a portion of the outer circumferential surface of the cam 32, and the position detecting sensor 38 is arranged over the detection plate 32*c* in the belt device 15. The position detecting sensor 38 optically detects a position of the detection plate 32*c*, and thereby determining a posture of the cam 32 in the rotating direction so as to control a travel distance of the correction roller 13 in any of the directions X1 and X2.

In the present embodiment, regardless of the bias force of the tension spring 35, when the shaft 32*a* is located higher than the center of the cam 32 in a state where the cam 32 is nipped into a bottom inner surface of the contact portion 31*a* due to the rotation of the cam 32, the contact portion 31*a* is pushed down in the direction M1 (the backward direction) in a state where the cam 32 is in contact with the bottom inner surface of the contact portion 31*a*. As a result, the correction roller 13 is moved in the direction X1 shown in FIG. 6 around the oscillating center W.

Subsequently, a configuration and an operational behavior of the adjusting member 60 as one of characteristic features of the belt device 15 according to the present embodiment is explained in detail below with reference to FIGS. 8 and 9A to 9C.

As shown in FIG. 8, the adjusting member 60 is attached to a shaft portion 13*a* of the correction roller 13 on the side of the fixed end (the front side of the belt device 15). The adjusting member 60 adjusts a position of the fixed end of the correction roller 13. Specifically, the shaft portion 13*a* (the fixed end) of the correction roller 13 is rotatably supported by the frame 70 of the belt device 15 via the adjusting member 60. The adjusting member 60 includes a circular cam 60*a*, a holding unit 60*b*, and a long hole 60*c*.

The shaft portion 13*a* penetrates through the circular cam 60*a*. In conjunction with the eccentric rotation of the circular cam 60*a* in directions R1 and R2 shown in FIG. 8, the shaft portion 13*a* is caused to rotate eccentrically. Specifically, an outer circumferential surface of the circular cam 60*a* has a circular shape, and the circular cam 60*a* is engaged with a hole portion formed on the frame 70. A hole portion is formed on the circular cam 60*a* at an eccentric position with respect to the center of the circular cam 60*a*. The shaft portion 13*a* penetrates through the hole portion. In accordance with rotation of the circular cam 60*a*, the shaft portion 13*a* moves in the forward and backward directions (the up and down directions).

The holding unit 60*b* is integrally molded with the circular cam 60*a*, and rotates along with the circular cam 60*a*. A worker grips and turns the holding unit 60*b* so as to turn the circular cam 60*a* thereby adjusting a position of the shaft portion 13*a*. A peripheral edge of the holding unit 60*b* is formed into a saw-tooth shape so that the worker can grip the holding unit 60*b* firmly.

The long hole 60*c* has a shape of circular arc centered around the rotation center of the circular cam 60*a*. The long hole 60*c* serves as a posture retaining unit for retaining a posture of the circular cam 60*a* in the rotating direction. Specifically, a screw 65 is screwed in a female screw portion of the frame 70 via the long hole 60*c*. Therefore, a position of the shaft portion 13*a* with respect to the frame 70 is determined without turning the circular cam 60*a* (the adjusting member 60).

When a default position of the correction roller 13 is significantly deviated in either the forward or backward direction away from a center position of a travel range of the correction roller 13, for example, because the supporting rollers 11, 12A to 12C, and 13 are installed in the belt device 15 in a state where the parallelism of the supporting rollers 11, 12A to 12C, and 13 is not sufficiently maintained, because the frame 70 that rotatably supports the supporting rollers 11, 12A to 12C, and 13 is distorted, or because the straightness of the supporting rollers 11, 12A to 12C, and 13 is not sufficiently maintained, the adjusting member 60 is manually operated so that the default position of the correction roller 13 comes to the center position of the travel range. Such a position adjustment is mostly performed by a worker in the last stage of an assembling process of the belt device 15 at a manufacturing facility. After the belt device 15 is marketed, when the default position of the correction roller 13 is significantly deviated away from the center position of the travel range, for example, due to a distortion of the frame 70, the adjusting member 60 is operated by a serviceman.

Therefore, the belt device 15 can prevent occurrences of such conventional problems that the belt device 15 is caused stop operation because it is determined that a control error occurs when a meandering of the intermediate transfer belt 8 is not corrected within a predetermined time, and a meandering of the intermediate transfer belt 8 cannot be sufficiently corrected within the travel range of the correction roller 13.

Specifically, when a position of the shaft portion 13*a* of the correction roller 13 in a state shown in FIG. 9A is to be moved upward, the screw 65 is loosened, and the holding unit 60*b* is turned in the direction R2 (see FIG. 9B). On the other hand, when the position of the shaft portion 13*a* of the correction roller 13 is to be moved downward, the screw 65 is loosened, and the holding unit 60*b* is turned in the direction R1 (see FIG. 9C). When the position of the shaft portion 13*a* is determined, the screw 65 is tightened so as to fix the posture of the circular cam 60*a* in the turning direction. As actual procedures for adjusting the position of the shaft portion 13*a*, after the position of the shaft portion 13*a* located on the fixed-end side is temporarily determined by operating the adjusting member 60 (i.e., after the screw 65 is temporarily tightened), the posture of the cam 32 located on the side of the other end is adjusted to the center position of the travel range (by adjusting the oscillating arm 31 to be in a substantially horizontal state), and at the end, the position of the shaft portion 13*a* is determined by operating the adjusting member 60 (and the screw 65 is fully tightened).

In the present embodiment, the adjusting member 60 is arranged on the operating side (i.e., the front side of the printer 100 where an openable cover is provided to be opened when the belt device 15 is attached to or removed from the printer 100). Therefore, it is possible to improve the operability when the adjusting member 60 is manually operated.

Furthermore, the adjusting member 60 is designed to be relatively compact so as not to interfere with the intermediate transfer belt 8 when the intermediate transfer belt 8 is replaced. To downsize the adjusting member 60, although a trajectory of the shaft portion 13*a* that is moved in an arc by the adjusting member 60 is not coincident with a trajectory of the shaft portion 13*b* that is moved in an arc by the meandering correcting mechanism (the arc of the shaft portion 13*a* has a smaller diameter than that of the shaft portion 13*b*), both the shaft portions 13*a* and 13*b* are configured to move in the same direction, i.e., in the up or down direction enough to fulfill the function of the adjusting member 60.

Alternatively, instead of the adjusting member 60, it is possible to use an adjusting unit capable of adjusting the position of the shaft portion 13*a* so that the trajectory of the shaft portion 13*a* is fully (or partially) coincident with the trajectory of the shaft portion 13*b* (in the directions X1 and X2) moved by the meandering correcting mechanism as viewed on a cross section perpendicular to the rotating shaft of the correction roller 13.

Figure 10:
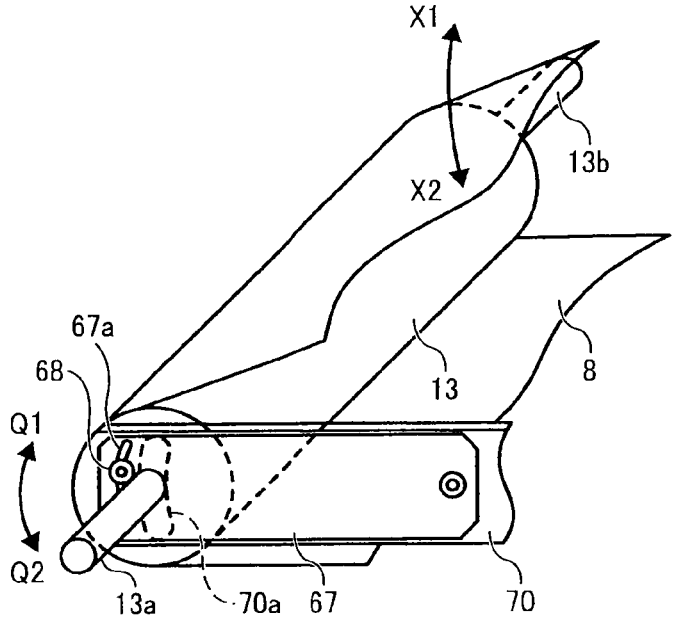
FIG. 10 is a perspective view of the portion of the belt device including an adjusting member as a modified example of that is shown in FIG. 8.

A configuration and an operational behavior of the adjusting unit as a modified example of the adjusting member 60 are explained below with reference to FIG. 10. The shaft portion 13*a* penetrates through a long hole 70*a* formed on the frame 70. The long hole 70*a* is formed so that a trajectory of the shaft portion 13*a* that is moved in an arc within a range of the long hole 70*a* (in directions Q1 and Q2) overlaps with a trajectory of the shaft portion 13*b* moved by the oscillating arm 31 (in the directions X1 and X2) as viewed on the cross section perpendicular to the rotating shaft of the correction roller 13. Therefore, even when the shaft portion 13*b* is significantly deviated in either the forward or backward direction away from the center position of the travel range (in the directions X1 and X2), the default position of the correction roller 13 can be efficiently and reliably adjusted by the adjusting unit.

Incidentally, upon completion of the adjustment of the position of the shaft portion 13*a* in any of the directions Q1 and Q2, a screw 68 is screwed in the female screw portion of the frame 70 via an arc-shaped long hole 67*a* formed on a holding member 67, which holds the shaft portion 13*a* and moves along with the shaft portion 13*a*, whereby the position of the shaft portion 13*a* in the turning direction is determined.

As described above, the belt device 15 according to the present embodiment is configured to be capable of adjusting a position of the fixed end of the correction roller 13 for correcting a meandering of the intermediate transfer belt 8.

Therefore, even when the supporting rollers 11, 12A to 12C, and 13 supporting the intermediate transfer belt 8 are installed in the belt device 15 in a state where the parallelism of the supporting rollers 11, 12A to 12C, and 13 is not sufficiently maintained, the frame that rotatably supports the supporting rollers 11, 12A to 12C, and 13 is distorted, or the straightness of the supporting rollers 11, 12A to 12C, and 13 is not sufficiently maintained, a meandering of the intermediate transfer belt 8 can be reliably corrected with a relatively simple configuration.

Incidentally, in the present embodiment, the present invention is applied to the belt device 15 including the intermediate transfer belt 8 as a belt member. However, the present invention is not limited to the embodiment. For example, the present invention can be applied to a belt device including a conveying belt as a belt member (in this belt device, a plurality of toner images in different colors is transferred onto a recording medium conveyed on the conveying belt) or a belt device including a photosensitive element belt (i.e., an endless-belt type of a photosensitive element that performs the same function as the photosensitive drums in the present embodiment) as a belt member. In these belt devices, it is just configured so as to adjust a position of a fixed end of a roller member for correcting a meandering of the belt member, whereby it is possible to achieve the same effect as the belt device 15 according to the embodiment.

Furthermore, in the present embodiment, the adjusting member 60 is configured to be manually operated. Alternatively, it is also possible to configure the adjusting member 60 to be automatically operated. Furthermore, a gear portion can be provided on the peripheral edge of the holding unit 60*b* of the adjusting member 60. In this case, a gear engaged with the gear portion is configured to be driven to rotate in the forward or backward direction by a stepping motor.

According to an aspect of the present invention, a belt device is configured to be capable of adjusting a position of a fixed end of a roller member for correcting a meandering of a belt member. Therefore, even when a plurality of supporting rollers supporting the belt member is installed in the belt device in a state where the parallelism of the supporting rollers is not sufficiently maintained, a frame that rotatably supports the supporting rollers is distorted, or the straightness of the supporting rollers is not sufficiently maintained, a meandering of the belt member can be reliably corrected with a relatively simple configuration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A belt device comprising:

a belt member that is supported by a plurality of rollers and moves in a predetermined moving direction;

a detecting unit that detects a displacement of the belt member in its width direction;

a correcting unit that moves during operation of the belt device, a second end of a first roller from among the rollers in either one of a forward direction and a backward direction while keeping its first end at a fixing position, based on a result of detecting the displacement of the belt member such that a tilt of a rotating shaft of the first roller is changed to correct a meandering of the belt member; and an adjusting unit that adjusts the fixing position of the first end.

2. The belt device according to claim 1, wherein the adjusting unit is a manual adjusting unit that manually adjusts the fixing position of the first end.

3. The belt device according to claim 1, wherein the adjusting unit is arranged on a side where an operation of attaching or removing the belt device is performed.

4. The belt device according to claim 1, wherein the adjusting unit includes a circular cam in which a shaft portion of the first end is inserted and causes the shaft portion to rotate eccentrically when the adjusting unit adjusts the fixing position of the first end, a holding unit that rotates along with the circular cam, and a maintaining unit that maintains a posture of the circular cam in its rotating direction.

5. The belt device according to claim 4, wherein a peripheral edge of the holding unit is formed in a saw-tooth shape.

6. The belt device according to claim 1, wherein the adjusting unit adjusts the fixing position of the first end by moving the fixing position in either one of a forward direction and a backward direction.

7. The belt device according to claim 6, wherein the adjusting unit adjusts the fixing position of the first end so that a trajectory of the first end is at least partially coincident with a trajectory of the second end moved by the correcting unit.

8. The belt device according to claim 1, wherein the correcting unit includes a connecting member that is connected to a shaft portion of the second end and is rotatably supported to rotate around a spindle, and a cam that makes contact with the connecting member to rotate the connecting member.

9. An image forming apparatus comprising:

a belt device including a belt member that is supported by a plurality of rollers and moves in a predetermined moving direction, a detecting unit that detects a displacement of the belt member in its width direction, a correcting unit that moves during operation of the belt device, a second end of a first roller from among the rollers in either one of a forward direction and a backward direction while keeping its first end fixed at a fixing position, based on a result of detecting the displacement of the belt member such that a tilt of a rotating shaft of the first roller is changed to correct a meandering of the belt member, and an adjusting unit that adjusts the fixing position of the first end.

10. A belt device comprising:

a belt member that is supported by a plurality of rollers and moves in a predetermined moving direction;

a detecting unit that detects a displacement of the belt member in its width direction;

a correcting unit that moves during operation of the belt device, a second end of a first roller from among the rollers in either one of a forward direction and a backward direction while keeping its first end in a fixed position, based on a result of detecting the displacement of the belt member such that a tilt of a rotating shaft of the first roller is changed to correct a meandering of the belt member;

a frame that rotatably supports the first end of the first roller; and an adjusting member that includes a cam which is engaged with the frame and into which the first end of the first roller is inserted at an eccentric position with respect to a center of the cam, so as to adjust a position of the first end of the first roller in accordance with rotation of the cam.

11. The belt device according to claim 10, wherein the cam has a circular shape and is engaged with a hole portion formed on the frame.

12. The belt device according to claim 10, wherein the adjusting member includes a holding unit which rotates along with the cam.

13. The belt device according to claim 10, wherein the adjusting member includes a long hole having a shape of circular arc centered around a rotation center of the cam; and a fixing member that fixes the adjusting member to the frame via the long hole.

14. A belt device comprising:

a belt member that is supported by a plurality of rollers and moves in a predetermined moving direction;

a detecting unit that detects a displacement of the belt member in its width direction;

a correcting unit that moves during operation of the belt device, a second end of a first roller from among the rollers in either one of a forward direction and a backward direction while keeping its first end in a fixed position, based on a result of detecting the displacement of the belt member such that a tilt of a rotating shaft of the first roller is changed to correct a meandering of the belt member;

a frame that rotatably supports the first end of the first roller; and a holding member that holds the first end of the first roller, wherein the frame includes a long hole formed thereon into which the first end of the first roller is inserted, and the first end of the first roller is moved by moving the holding member so that a position of the first end is adjusted.

15. The belt device according to claim 14, wherein a trajectory of the first end of the first roller moved in an arc with in a range of the long hole overlaps with a trajectory of the second end of the first roller moved in an arc by the correcting unit as viewed when projected on a plane fixed in space substantially perpendicular to the rotating shaft of the first roller.

16. The belt device according to claim 14, wherein the holding member includes a long hole formed thereon; and a fixing member that fixes the holding member to the frame via the long hole.

* * * * *